US007956307B2

(12) United States Patent
Ahn

(10) Patent No.: US 7,956,307 B2
(45) Date of Patent: Jun. 7, 2011

(54) CIRCUIT BREAKER HAVING AUTOMATIC RELEASE LINKAGE

(75) Inventor: Kil Young Ahn, Daejeon (KR)

(73) Assignee: LS Industrial Systems Co., Ltd, Gyeonggi-Do (KR)

( * ) Notice: Subject to any disclaimer, the term of this patent is extended or adjusted under 35 U.S.C. 154(b) by 492 days.

(21) Appl. No.: 12/190,073

(22) Filed: Aug. 12, 2008

(65) Prior Publication Data

US 2009/0050605 A1 Feb. 26, 2009

(30) Foreign Application Priority Data

Aug. 20, 2007 (KR) ..... 10-2007-0083330

(51) Int. Cl.
*H01H 3/04* (2006.01)

(52) U.S. Cl. ..... 218/154; 200/400

(58) Field of Classification Search ..... 218/154, 218/7, 14, 153; 200/400, 401, 500, 501, 200/17 R See application file for complete search history.

(56) References Cited

U.S. PATENT DOCUMENTS

| | | | | |
|---|---|---|---|---|
| 5,424,701 | A * | 6/1995 | Castonguay et al. | 335/172 |
| 5,731,560 | A * | 3/1998 | Nebon et al. | 218/22 |
| 6,069,544 | A * | 5/2000 | Seymour et al. | 335/185 |
| 2009/0050460 | A1 * | 2/2009 | Ahn | 200/400 |

* cited by examiner

*Primary Examiner* — Renee Luebke
*Assistant Examiner* — Marina Fishman
(74) *Attorney, Agent, or Firm* — Lee, Hong, Degerman, Kang & Waimey

(57) ABSTRACT

Disclosed is a circuit breaker having an automatic release linkage capable of preventing damage and deformation of elements by automatic linkage release before electro-impulsive force generated from within the circuit breaker by a large short-circuit current causes the damage and deformation of open/close linkage.

6 Claims, 10 Drawing Sheets

CIRCUIT BREAKER HAVING AUTOMATIC RELEASE LINKAGE

CROSS-REFERENCE TO RELATED APPLICATIONS

Pursuant to 35 U.S.C. §119(a), this application claims the benefit of earlier filing date and right of priority to Korean Patent Application No. 10-2007-0083330 filed on Aug. 20, 2007, the contents of which is hereby incorporated by reference herein in its entirety.

TECHNICAL FIELD

The following description relates generally to a circuit breaker, and more particularly to a circuit breaker having an automatic release linkage capable of preventing damage and deformation of elements by automatic linkage release before electro-impulsive force generated from within the circuit breaker by a large current and short-circuit causes the damage and deformation of open/close linkage.

BACKGROUND ART

Generally, a circuit breaker is an electric protecting apparatus installed between an electric source and load units for protection of load units such as a motor and a transformer and an electric line from an abnormal current (a large current caused by i.e., short circuit and ground fault) generated at an electric circuit such as a power transmission/distribution line and private power transforming facilities. In other words, a circuit breaker is an automatic electrical switch that stops or restricts the flow of electric current in a sudden overloaded or otherwise abnormally stressed electrical circuit. A circuit breaker provides automatic current interruption to a monitored circuit when undesired over-current conditions occur. The over-current condition includes, for example, arc faults, overloads, ground faults, and short-circuits.

In addition, the circuit breaker insulated by insulation material at a breaking mechanism may manually open or close an electric line under normal use state, and open or close the line from a remote distance using an electric manipulation unit outside a metal container and automatically break the line during over-current and short-circuit to protect the power facilities and load units.

In order to break the line, the air circuit breaker is equipped with a stationary contactor and a movable contactor at a breaking mechanism where a current is made to flow in normal situation by connecting the stationary contactor and the movable contactor, and when there occurs a failure at any portion of the line to allow flowing a large current, the movable contactor is instantly separated from the stationary contactor to open the circuit.

A normal load current flows at a connected (service) position where the movable contactor and the stationary contactor are completely connected, such that the breaker can sustain an impact force caused by short-circuit current for a predetermined time against the short-circuit current according to load capacity of the circuit breaker. The short-circuit current sustainable by the circuit breaker is detected by a trip relay and an actuator to trip an operating mechanism.

FIG. 1 is a schematic configuration of a conventional circuit breaker in which a trip spring is compressed to allow a contact point to be turned off, FIG. 2 is a schematic configuration of a conventional circuit breaker in which a trip spring is elongated to allow a contact point to be turned off, and FIG. 3 is a schematic configuration in which an over-current is applied to turn off the contact point in the exemplary implementation of FIG. 2.

Referring to FIGS. 1 to 3, one of upper and lower terminal (1, 2) composed of a stationary contact point and a movable contact point may be fixed, and the circuit breaker may include a movable conduction unit (3) rotatably formed at one of the upper and lower terminal (1, 2) and an operation mechanism (10) rotating the movable conduction unit (3) to turn on or off the movable contact point and the stationary contact point.

Under the connected (ON) state, an open lever (23) and an open latch (22) are mutually connected to maintain an ON state in which the movable conduction unit (3) and the stationary contact point are contacted, and when a large current caused by fault conditions (including, but are not limited to, current overload, ground faults, over voltage conditions and arcing faults) is detected, a trip solenoid (19) may rotate the open lever (23) to release the contacted condition between the open lever (23) and the open latch (22), thereby performing the OFF operation of separating the movable contact unit (3) from the upper terminal (1).

To be more specific, FIG. 1 refers to an OFF state of the contact point at the movable conduction unit (3) of the circuit breaker, and an open/close axis (14) of the operation mechanism (10) rotated to be brought into contact with an open/close axis stopper (18). A connection spring (56) is compressed by a rotating driver lever (16) due to rotation of a cam (12) caused by a motor or a manual handle (not shown), as illustrated in FIG. 1. The cam (12) in which the connection spring (56) is compressed may maintain equilibrium by an ON lever (20) contacting a connection latch (13). An ON coupling (17) contacting a connection button (25) or a connection solenoid (not shown) may be in a position that can rotate the ON lever (20).

When the ON coupling (17) moves down to rotate the ON lever (20), the connection latch (13) releases the cam (12), and force of the connection spring (56) is transmitted to a toggle link (15) through the driver lever (16), whereby the open/close axis (14) is rotated clockwise to expand an open spring (57) as illustrated in FIG. 2. The movable conduction unit (3) may contact the stationary contact point of the upper terminal (1) in response to the clockwise rotation of the open/close axis to conduct the lower terminal (2) and the upper terminal (2). Concurrently, a compression spring (58) is also compressed in order to allow the circuit breaker to have a resistance for a short period of time (capacity of conducting a short-circuited current for a second). The compression spring (58) applies a force toward the opening of the movable conduction unit (3).

As illustrated in FIG. 2, the equilibrium of the circuit breaker being connected is maintained while the open latch (22) is latched to the open lever (23) through the toggle link (15) and a connection link (28). At this time, the OFF operation is such that, when the open lever (23) is rotated by an open button (26), an OFF plate or the trip solenoid (19), the open latch (22) is rotated to release the toggle link (15) toggled under the connected condition to allow the open/close axis (14) to be counterclockwise rotated by the open spring (57) and the compression spring (58) and to allow the contact points to be in the OFF state as shown in FIG. 3. The cam (12) may be rotated again in order to compress the connection spring (56), as shown in FIG. 1.

If over-current flows while the circuit breaker is in the connection state as shown in FIG. 2, an electro-impulsive (impact) force is generated by a current between the movable conduction unit (3) and the stationary contact point of the upper terminal by the electro-dynamic compensation effect.

The impact force may be transmitted to elements in various operational mechanisms (10) such as the toggle link (15), the connection link (28) and the open latch (22) via a transmission link (4).

Although the circuit breaker can withstand the impact force within the scope of the resistance for a short period of time with the assistance of the compression force of the compression spring (58) and the toggle ling (15), but if a short-circuit current greater than normal flows in the movable conduction unit (3), a large impact force is transmitted to the operational mechanisms via the transmission link (4) to deform or do damage to the toggle link (15) before a trip relay (not shown) and the trip solenoid (19) release the open lever (23).

Technical Problem

The present invention is provided in view of the above problems, and the above discussed and other drawbacks and deficiencies of the prior art are overcome or alleviated by a circuit breaker having automatic release linkage capable of preventing damage and deformation of elements by automatic linkage release before electron-impact force generated from within the circuit breaker by a large current and short-circuit causes the damage and deformation of open/close linkage.

The foregoing and other objects, features, aspects and advantages of the present invention will become more apparent from the following detailed description of the present invention and exemplary implementations when taken in conjunction with the accompanying drawings.

Technical Solution

A circuit breaker having an automatic release linkage for accomplishing the aforementioned objects including a movable conduction unit (3) for selectively conducting a first terminal (2) and a second terminal (1) by contacting the second terminal (1) while being electrically contacted to the first terminal (2), and an open/close linkage including a connection linkage (140) for transmitting a impact force from the movable conduction unit (3) to a trip roller (55) as an operational force, the circuit breaker comprises: an open lever (190); a second link (160) rotatably formed about a latch pin (150*a*); a third link (170) having a meshed lateral cross-sectional surface by being latched with an outer circumferential surface of the open lever (190) while moving relative to the second link (160) by rotatably fixing the trip roller (55); and a spring (180) so interposed between the second link (160) and the third link (170) as to apply an elastic force (Fs) toward an operational line (99), wherein a branch force (77*p*) toward the operational line of an operational force (77) reacts in opposition to the elastic force (Fs), and a latched state of a lateral cross-sectional surface of the third link (170) with the open lever (190) is released at all times under any circumstance when the branch force (77*p*) is greater than the elastic force (Fs) by a predetermined level.

Implementations of this aspect may include one or more of the following features.

The second link (160) may be protrusively formed at a lateral surface thereof with a friction pin (161), and the third link (170) may be piercingly formed with an oblong hole (172) in which the friction pin (161) can be inserted lengthwise at a lateral surface facing the second link (160) so as to move relative to the second link (160).

The connection link (140) may be formed with a stopper surface (140*c*) at a surface contacting the trip roller (55), where the stopper surface (140*c*) prevents a further movement of the connection link (140) contacting the trip roller (55) when there is generated a relative movement of the connection link (140) as long as a predetermined distance by the reaction of impact force (88).

The third link (170) may include a curved surface (170*a*) at a lateral cross-sectional surface contacting the open lever (190) for being meshed with an outer circumferential surface of the open lever (190), and a point-tipped apex (170*b*) formed at a distal end of the curved surface (170*a*).

The oblong hole (172) at the third link (170) may be in parallel with the operational line (99) of the spring (180).

The third link (170) may further include a pair of spring seats (181) formed at each side of the second link (160) for being fixedly disposed between a pair of third links (170), and the spring (180) is compressively or extendably formed between the spring seat (181) and the second link (160).

Advantageous Effects

The circuit breaker having an automatic release linkage according to a first exemplary implementation operates in such a manner that an elastic force is activated by a spring so that a lateral cross-sectional surface of a third link can be adhered to an open lever, a branch force of operational force activated from a connection link relative to a trip roller rotatably mounted at the third link can be reacted in opposition to the elastic force, whereby the lateral surface of the third link can be released while being meshed with an outer circumferential surface of the open lever, even if an impact force from a movable conduction unit is greatly reacted, prompting an automatic release of restriction between an open/close linkage and a trip roller, and effectively preventing breakage of elements at the open/close linkage including an open/close axis, a toggle link and a connection link.

BEST MODE

Figure 1:
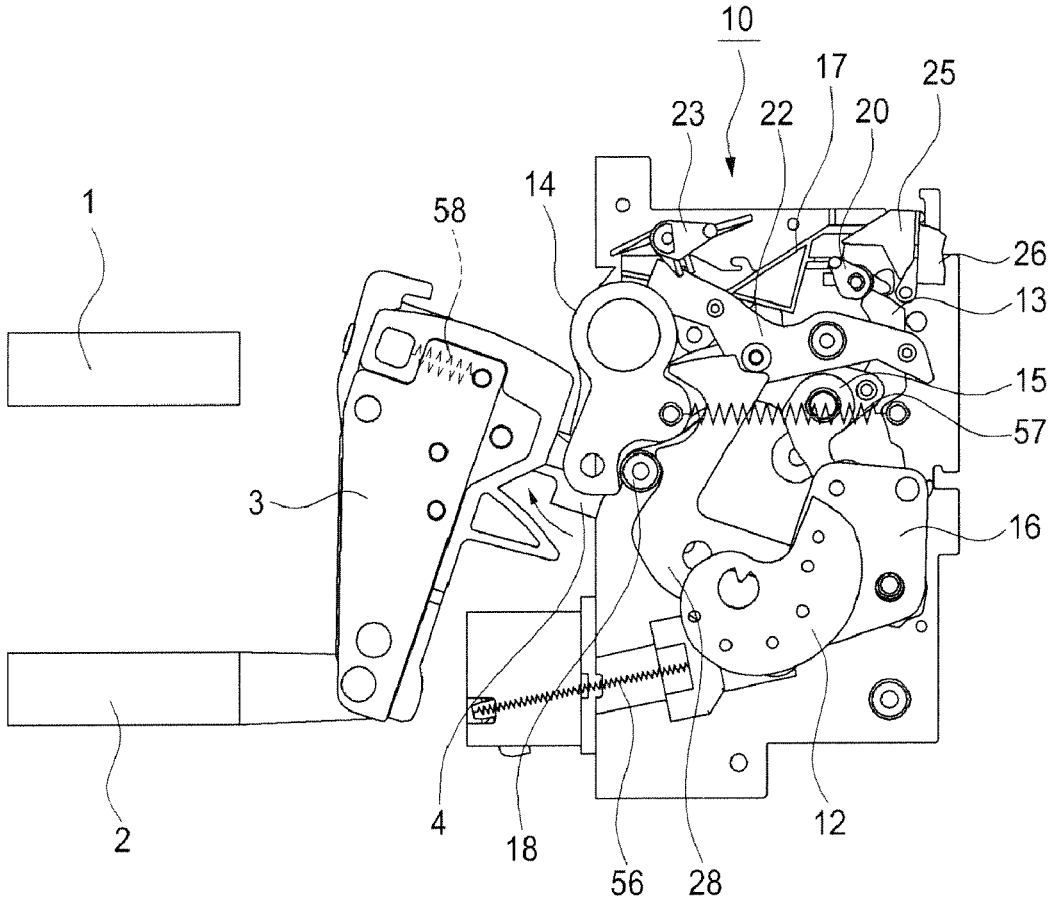
FIG. 1 is a configurative drawing of a circuit breaker in which a connection spring is compressed to turn off a contact point.
Figure 2:
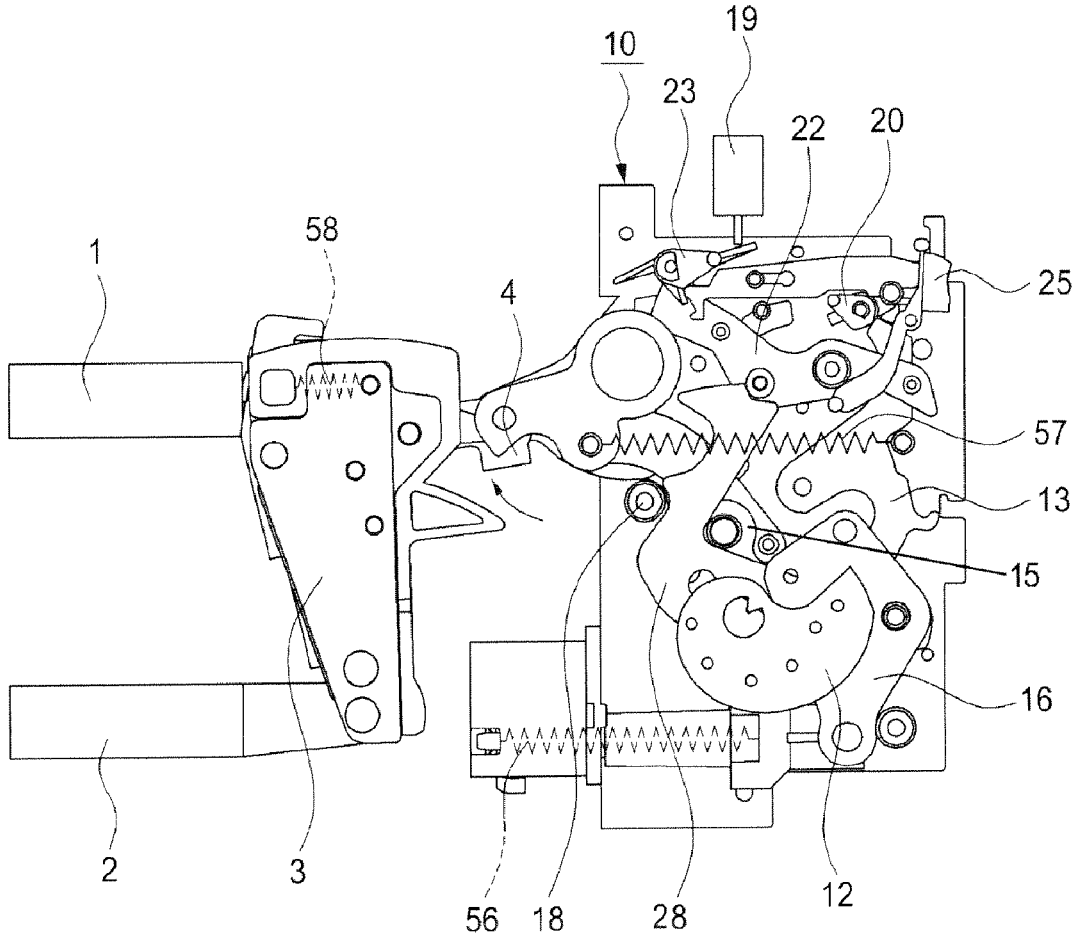
FIG. 2 is a configurative drawing of a circuit breaker in which a connection spring is expanded to turn on a contact point.
Figure 3:
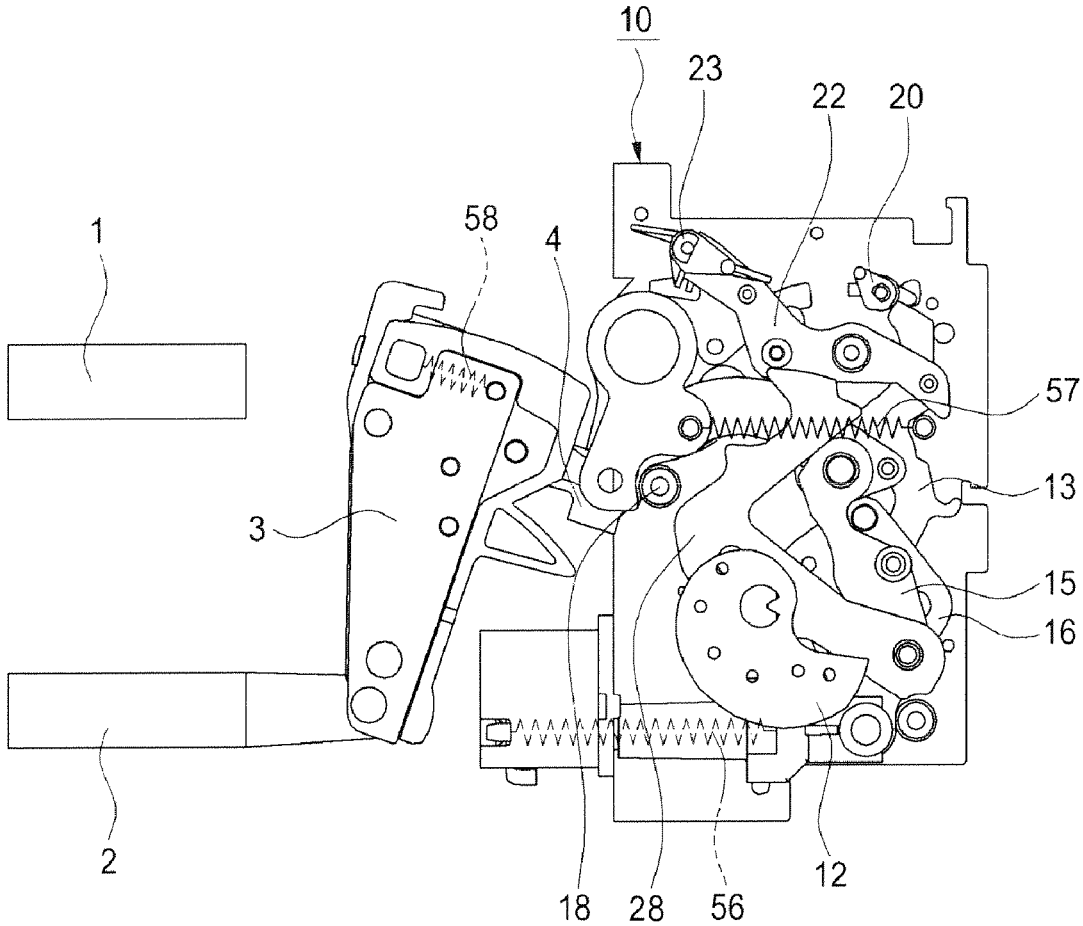
FIG. 3 is a configurative drawing in which an over-current is applied to turn off a contact point according to an exemplary implementation of FIG. 2.

Exemplary implementations of a circuit breaker having an automatic release linkage according to the present novel concept will be described in detail with reference to the accompanying drawings, preferably FIGS. 1 to 3. Detailed description with regard to known art or construction will be omitted for clarity of the invention.

Figure 4:
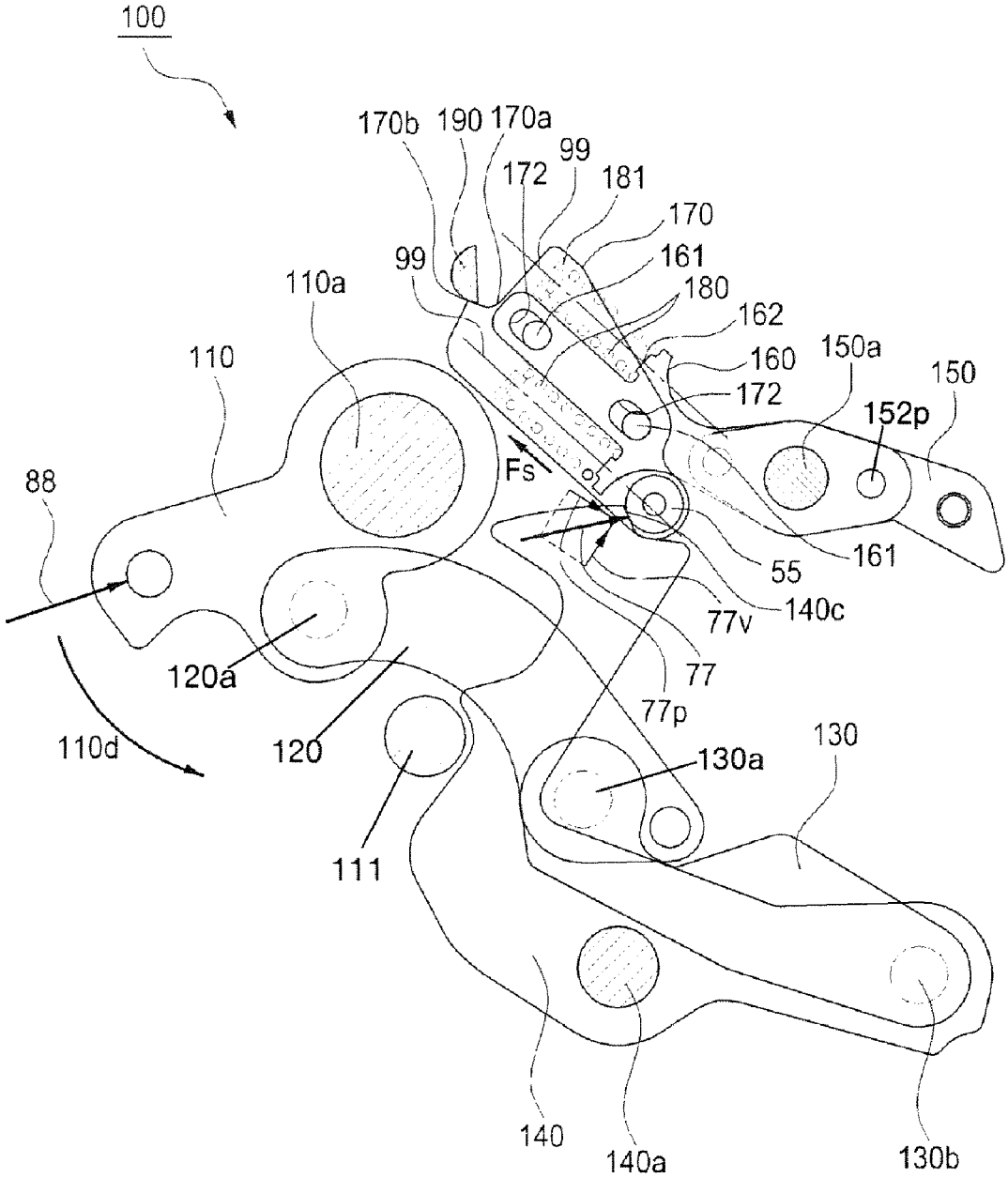
FIG. 4 is a configurative drawing of principal elements in which a connection state of an open/close linkage and an automatic release linkage in the circuit breaker is shown according to an exemplary implementation.
Figure 5:
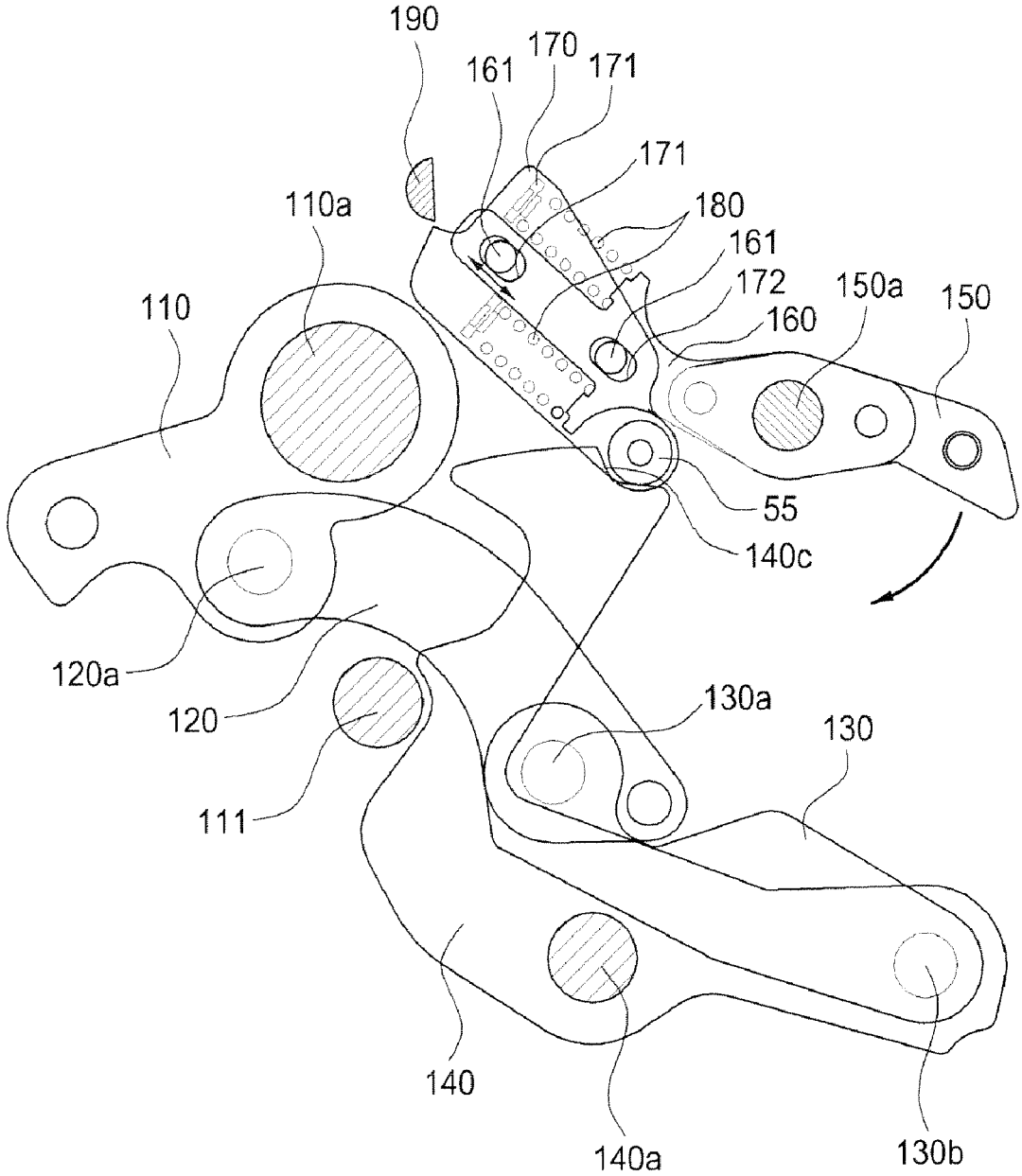
FIG. 5 is a configurative drawing of automatic release operational state according to the exemplary implementation of FIG. 4.
Figure 6:
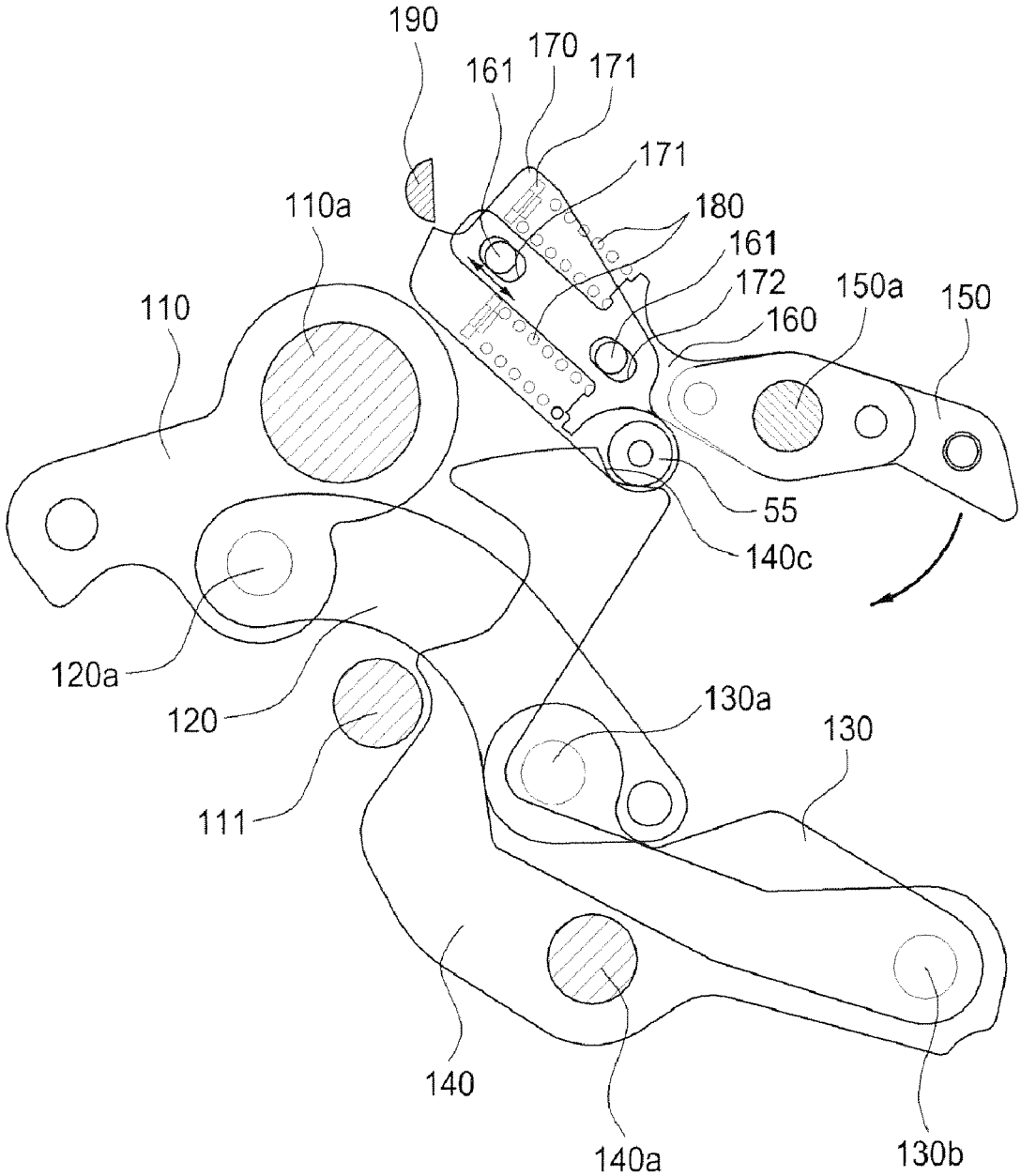
FIG. 6 is a configurative drawing of an automatic release operational state having been completed according to the exemplary implementation of FIG. 4.
Figure 7:
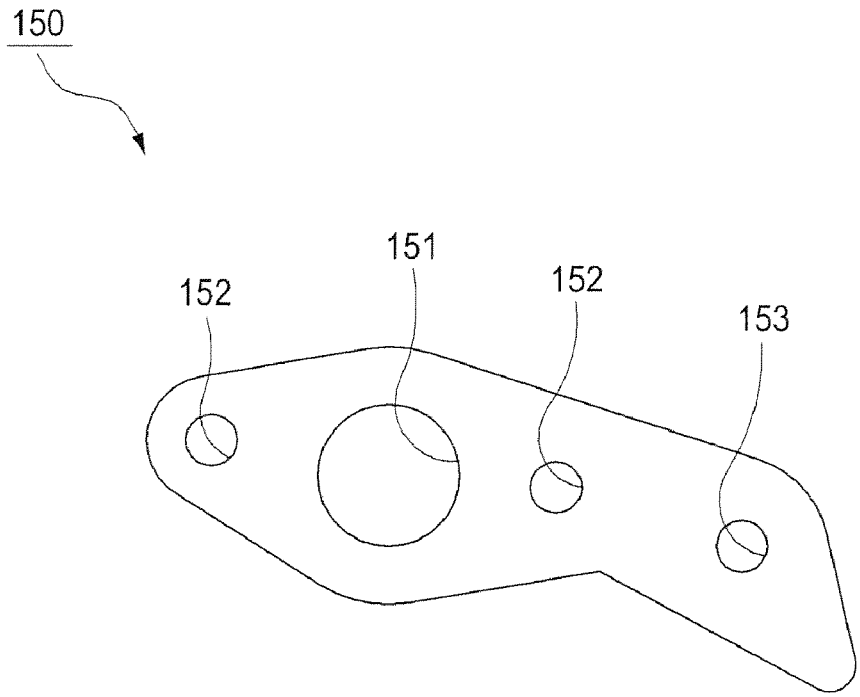
FIG. 7 is a lateral view of a first link according to the exemplary implementation of FIG. 4.
Figure 8:
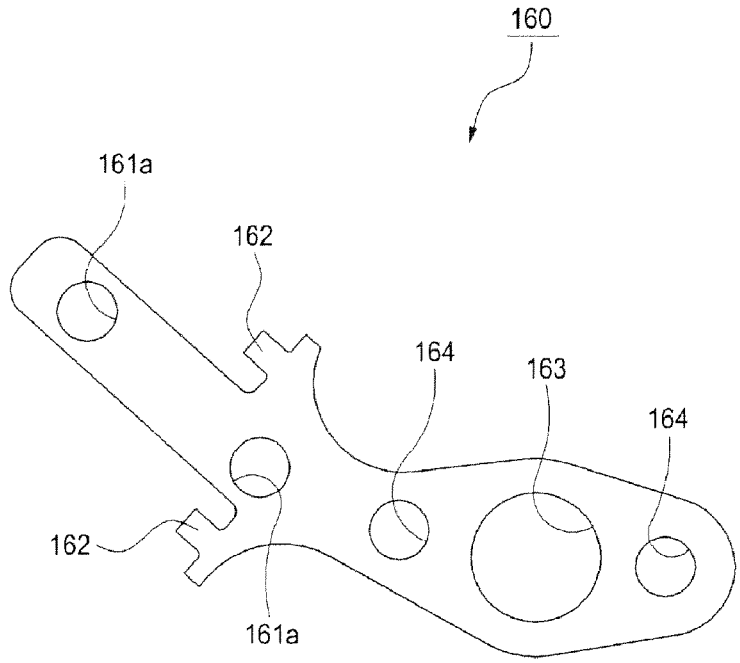
FIG. 8 is a lateral view of a second link according to the exemplary implementation of FIG. 4.
Figure 9:
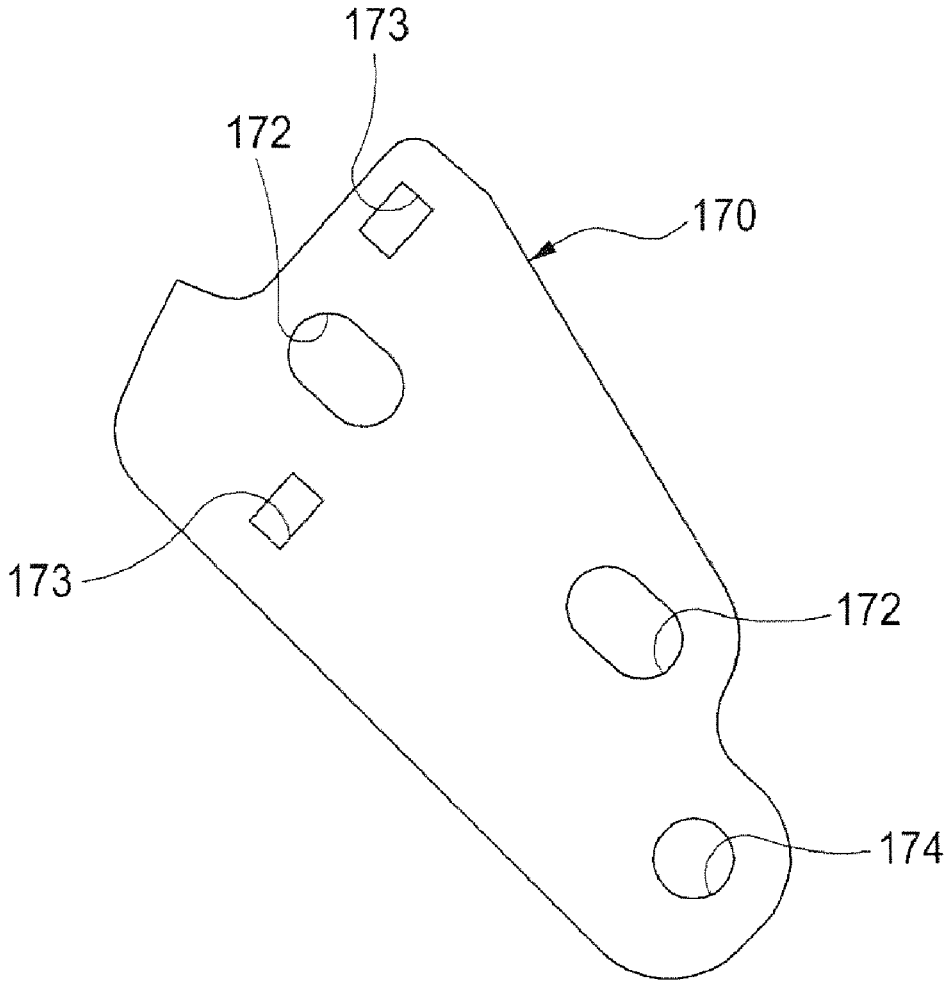
FIG. 9 is a lateral view of a third link according to the exemplary implementation of FIG. 4.
Figure 10:
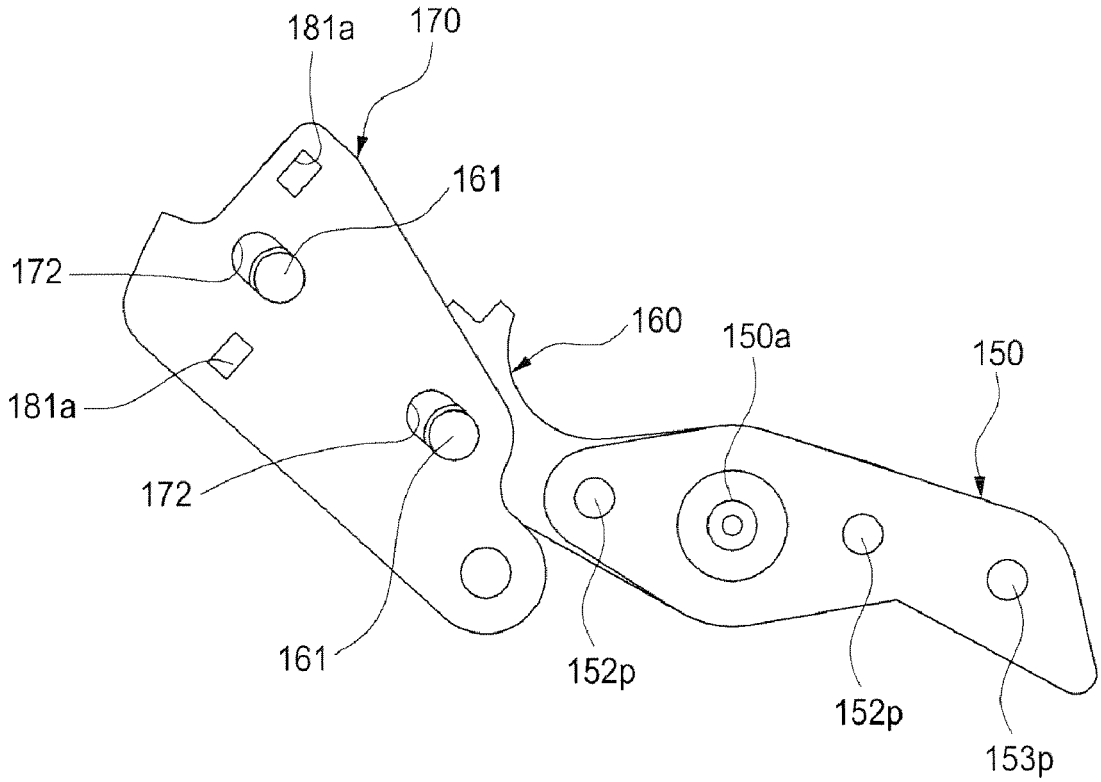
FIG. 10 is a lateral view of an automatic release linkage according to the exemplary implementation of FIG. 4.
Figure 11:
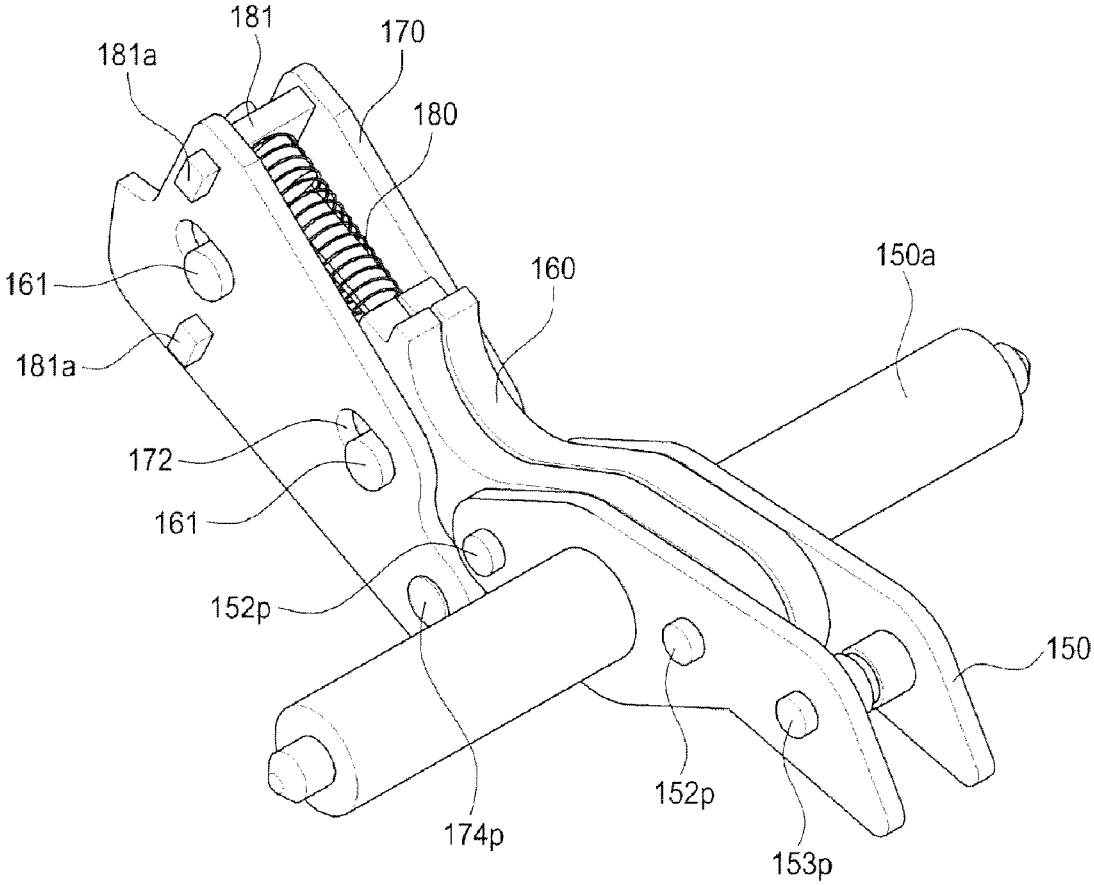
FIG. 11 is a perspective view of an exemplary implementation of FIG. 10.

FIG. 4 is a configurative drawing of principal elements in which a connection state of an open/close linkage and an automatic release linkage in the circuit breaker is shown according to an exemplary implementation, FIG. 5 is a configurative drawing of automatic release operational state according to the exemplary implementation of FIG. 4, FIG. 6 is a configurative drawing of an automatic release operational state having been completed according to the exemplary implementation of FIG. 4, FIG. 7 is a lateral view of a first link according to the exemplary implementation of FIG. 4, FIG. 8 is a lateral view of a second link according to the exemplary implementation of FIG. 4, FIG. 9 is a lateral view of a third link according to the exemplary implementation of FIG. 4, FIG. 10 is a lateral view of an automatic release linkage according to the exemplary implementation of FIG. 4, and FIG. 11 is a perspective view of an exemplary implementation of FIG. 10.

A circuit breaker according to the present invention may include open/close linkages (110, 120, 130, 140, hereinafter referred to as 110-140') applying an operational force (77) to a trip roller (55) in response to receipt of impact force (88) from a movable conduction unit (3), and automatic release linkages (150, 160, 170, 180, hereinafter referred to as '150-180') configured to automatically release the meshed state with an open lever (190) whose cross-sectional surface is shaped of a semi-circular pillar that contacts the third link (170) when the operational force (77) from the open/close linkages (110-140) is overly activated.

The open/close linkages (110-140) may include an open/close axis (110) rotatably formed toward the direction of reference numeral 110*d* relative to a stationary hinge axis (10*a*) when the impact force (88) from the movable conduction unit (3) is transmitted, a first toggle link (120) mutually and rotatably connected by the open/close axis (110) and a first connection pin (120*a*), a second toggle link (130) mutually and rotatably connected by the first toggle link (120) and a toggle pin (130*a*), and a connection link (140) mutually and rotatably connected by the second toggle link (130) and a second connection pin (130*b*) and rotatably disposed relative to a stationary hinge axis (140*a*).

The open/close linkages (110-140) may apply the operational force (77) to the trip roller (55) contacting a distal cross-sectional surface (140*c*) of the connection link (140) in response to the transmission of the impact force (88) from the movable conduction unit (3).

The automatic release linkages (150-180) may include a first link (150) rotatably formed relative to a latch pin (150*a*), a second link (160) integrally coupled by the first link (150) and a connection pin (152*p*) for rotation relative to the latch pin (150*a*), and disposed with a friction pin (161) protrusively formed at each lateral surface thereof, a third link (170) including a curved surface (170*a*) formed with an oblong hole (172) through which the friction pin (161) of the second link (160) can pass and a point-tipped apex (170*b*) formed at a distal end of the curved surface (170*a*), and a spring (180) disposed by being compressed as much as a predetermined value between a spring seat (181) fixed at the third link (170) and the second link (160).

Now, referring to FIGS. 7 and 11, the first link (150), to be exact, a pair of first links (150), may be formed at each lateral surface of the second link (160). The first link (150) may be piercingly and centrally formed with an eleventh connection hole (151) for accommodating the latch pin (150*a*). The first link (150) may be piercingly formed with a twelfth connection hole (152) riveted by the connection pin (152*p*) for integrally coupling the second link (160). The first link (150) may be piercingly formed with a thirteenth connection hole (153) inserted by a pin coupling the pair of the first links (150).

Referring to FIGS. 8 and 11, the second link (160), to be exact, a pair of second links, may be overlappingly formed at an inner side of the first link (150). The second link (160) may be piercingly formed with a friction hole (161*a*) into which the friction pin (161) can be inserted. The second link (160) may be protrusively formed with a lug (162) for stably fixing a distal end of the spring (180). The second link (160) may be piercingly and centrally formed with a twenty first connection hole (163) for accommodating the latch pin (150*a*). The second link (160) may be piercingly formed with a twenty second connection hole (164) insertedly riveted by the connection pin (152*p*) integrally coupled with the first link (150). The first and second link (150, 160) may be separately formed as a separate element, but may be integrally formed in one single body.

Now, referring to FIGS. 9 and 11, the third link (170), to be exact, a pair of third links, may be formed at an external side of the second link (160). The third link (170) may include an oblong hole (172) lengthwise formed toward the operational line (99) so that the friction pin (161) can slidably move therethrough, a piercingly formed spring seat fixation hole (173) inserted by a lug (181*a*) of the spring seat (181) for fixing the spring seat (181), and a through hole (174) inserted by a rotational axis of the trip roller (55) for rotatably coupling the trip roller (55). In so doing, the third link (170) can move as long as a length corresponding to that of the oblong hole (172) relative to the second link (160).

Referring now to FIG. 11, the spring (180) having a predetermined compression force is disposed toward the operational line (99) between the spring seat (181) and the second link (160). As a result, the third link (170) is always applied with a spring force (Fs) tending to be distanced toward the operational line (99) relative to the second link (160).

MODE FOR INVENTION

Now, the operational principle of the circuit breaker having an automatic release linkage will be described.

FIG. 4 is a configurative drawing of a circuit breaker in which the automatic release linkages (150-180) are assembled at a position of the open latch (22), where a connection state relative to principal elements of the circuit breaker is shown according to an exemplary implementation.

In other words, an open/close axis (110) is rotated clockwise to cause the movable conduction unit (3) to mutually connect the upper and lower terminal (1, 2) into an electrical conduction state therebetween.

Under the connected condition, when the impact force (88) generated by the movable conduction unit (3) is reacted on the open/close axis (110), the impact force (88) causes the trip roller (55) of the automatic release linkages (150-180) to be affected by the operational force (77) to the direction shown in FIG. 5 via the first and second toggle link (120, 130). The force prevents the first and third link (150, 170) from rotating counterclockwise relative to the latch pin (150*a*) in response to the elastic restoring force of the spring (180), and causes the third link (170) and the open lever (190) to be mutually connected, thereby allowing the toggle links (120, 130) to maintain the toggled and connected state. If the impact force (88, i.e., force generated by short-circuited current of 100 Ka) is a force capable of withstanding the circuit breaker, the open lever (190) must be rotated by a trip button (not shown) and a trip solenoid (not shown), such that trip can be realized as shown in FIG. 3.

However, if the impact force (88) generated by a short-circuited current (i.e., 150 Ka) higher than a predetermined level is acted on the open/close axis (110) under the connected condition, as illustrated in FIG. 4, a trip operation is progressed by the automatic release linkages (150-180) as contact with the open lever (190) is automatically released, which is transmitted to the open/close linkages (110-140) of the circuit breaker to prevent the damage to the toggle links (120, 130) or the connection link (140).

To be more specific, the operational force (77) perpendicularly acting on a contact surface between the trip roller (55) and the connection link (140) may be divided into a branch force (77*p*) which is in parallel with the elastic spring force (Fs) arranged at the automatic release linkages (150-180) in the direction of the operational force (99), and a vertical branch force (77*v*) perpendicular to the spring force (Fs). The parallel branch force (77*p*) may act on the trip roller (55) of the third link (170) and withstand a stationary friction force acting on the oblong hole (172) of the third link (170) and the friction pin (161) to attempt to compress the spring (180).

If the parallel branch force (77*p*) is greater than the spring force (Fs) and the friction force due to the large short-circuited current, the third link (170) and the trip roller (55) move to as far as the stopper surface (140*c*) of the connection link (140). The stopper surface (140*c*) is where a movement relative to the trip roller is no longer generated when the impact force is acted on the connection link (140) contacting the trip roller (55) to generate a relative movement as much as a predetermined amount, as illustrated in FIG. 4.

At this time, as depicted in FIG. 5, a contact surface between the open lever (190) and the third link (170) is released, and the automatic release linkages (150-180) are rotated about the latch pin (150*a*) (see FIG. 6) to rotate the open/close axis (110) and the toggle links (120, 130), thereby tripping the circuit breaker.

While the present invention has been particularly shown and described with reference to exemplary implementations thereof, the general inventive concept is not limited to the above-described implementations. It will be understood by those of ordinary skill in the art that various changes in form and details may be made therein without departing from the spirit and scope of the present invention as defined by the following claims.

INDUSTRIAL APPLICABILITY

The circuit breaker having an automatic release linkage operates in such a manner that an elastic force is activated by a spring so that a lateral cross-sectional surface of a third link can be adhered to an open lever, a branch force of operational force activated from a connection link relative to a trip roller rotatably mounted at the third link can be reacted in opposition to the elastic force, whereby the lateral surface of the third link can be released while being meshed with an outer circumferential surface of the open lever, even if an impact force from a movable conduction unit is greatly reacted, prompting an automatic release of restriction between an open/close linkage and a trip roller, and effectively preventing breakage of elements at the open/close linkage including an open/close axis, a toggle link and a connection link.

The invention claimed is:

1. A circuit breaker having an automatic release linkage including a movable conduction unit (3) for selectively conducting a first terminal (2) and a second terminal (1) by contacting the second terminal (1) while being electrically contacted to the first terminal (2), and an open/close linkage including a connection linkage (140) for transmitting a impact force from the movable conduction unit (3) to a trip roller (55) as an operational force, the circuit breaker comprising: an open lever (190); a second link (160) rotatably formed about a latch pin (150*a*); a third link (170) having a meshed lateral cross-sectional surface by being latched with an outer circumferential surface of the open lever (190) while moving relative to the second link (160) by rotatably fixing the trip roller (55); and a spring (180) so interposed between the second link (160) and the third link (170) as to apply an elastic force (Fs) toward an operational line (99), wherein a branch force (77*p*) toward the operational line of an operational force (77) reacts in opposition to the elastic force (fs), and a latched state of a lateral cross-sectional surface of the third link (170) with the open lever (190) is released at all times under any circumstance when the branch force (77*p*) is greater than the elastic force (fs) by a predetermined level.

2. The circuit breaker as claimed in claim 1, wherein the second link (160) is protrusively formed at a lateral surface thereof with a friction pin (161), and the third link (170) is piercingly formed with an oblong hole (172) in which the friction pin (161) can be inserted lengthwise at a lateral surface facing the second link (160) so as to move relative to the second link (160).

3. The circuit breaker as claimed in claim 1, wherein the connection link (140) is formed with a stopper surface (140*c*) at a surface contacting the trip roller (55), where the stopper surface (140*c*) prevents a further movement of the connection link (140) contacting the trip roller (55) when there is generated a relative movement of the connection link (140) as long as a predetermined distance by the reaction of impact force (88).

4. The circuit breaker as claimed in claim 1, wherein the third link (170) comprises: a curved surface (170*a*) at a lateral cross-sectional surface contacting the open lever (190) for being meshed with an outer circumferential surface of the open lever (190); and a point-tipped apex (170*b*) formed at a distal end of the curved surface (170*a*).

5. The circuit breaker as claimed in claim 1, wherein the oblong hole (172) formed at the third link (170) is in parallel with the operational line (99) of the spring (180).

6. The circuit breaker as claimed in claim 1, wherein the third link (170) further comprises a pair of spring seats (181) formed at each side of the second link (160) for being fixedly disposed between a pair of third links (170), where the spring (180) is compressively or extendably formed between the spring seat (181) and the second link (160).

* * * * *